US009116466B2

(12) United States Patent
Makiguchi et al.

(10) Patent No.: US 9,116,466 B2
(45) Date of Patent: Aug. 25, 2015

(54) CARTRIDGE, PROCESS CARTRIDGE AND IMAGE FORMING APPARATUS

(71) Applicant: CANON KABUSHIKI KAISHA, Tokyo (JP)

(72) Inventors: Daisuke Makiguchi, Izunokuni (JP); Yoshiyuki Batori, Suntou-gun (JP); Ryuta Murakami, Suntou-gun (JP); Toshiaki Takeuchi, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/035,294

(22) Filed: Sep. 24, 2013

(65) Prior Publication Data

US 2014/0086621 A1 Mar. 27, 2014

(30) Foreign Application Priority Data

Sep. 27, 2012 (JP) ..... 2012-214341

(51) Int. Cl.
*G03G 15/08* (2006.01)

(52) U.S. Cl.
CPC ..... *G03G 15/0865* (2013.01); *G03G 15/0877* (2013.01); *G03G 15/0882* (2013.01); *G03G 15/0889* (2013.01)

(58) Field of Classification Search
CPC ..... G03G 15/0877; G03G 15/0865; G03G 15/0889; G03G 15/0882
USPC ..... 399/106, 105, 258
See application file for complete search history.

(56) References Cited

U.S. PATENT DOCUMENTS

| | | | |
|---|---|---|---|
| 5,911,096 | A | 6/1999 | Batori et al. |
| 5,920,753 | A | 7/1999 | Sasaki et al. |
| 5,930,562 | A | 7/1999 | Noda et al. |
| 5,937,237 | A | 8/1999 | Nonaka et al. |
| 5,940,658 | A | 8/1999 | Yokoi et al. |
| 6,075,957 | A | 6/2000 | Batori et al. |
| 6,101,348 | A | 8/2000 | Nonaka et al. |

(Continued)

FOREIGN PATENT DOCUMENTS

| | | | |
|---|---|---|---|
| JP | S63-294583 | A | 12/1988 |
| JP | H03-221981 | A | 9/1991 |

(Continued)

OTHER PUBLICATIONS

English translation of Japanese Patent Application Pub. No. H03-221981 A (Nov. 30, 1991).

*Primary Examiner* — Susan Lee
(74) *Attorney, Agent, or Firm* — Fitzpatrick, Cella, Harper & Scinto

(57) ABSTRACT

A cartridge includes: a toner chamber; and a toner supplying chamber for supplying a toner through a developer supply opening communicating with the toner chamber. The toner chamber includes: a feeding portion, including a rotatable member and a feeding sheet connected with the rotatable member, for feeding the toner from the toner chamber to the toner supplying chamber; and a toner seal member, including a first end portion and a second end portion, for unsealing the toner supply opening by being wound up by the rotatable member. During start of unsealing of the toner supply opening, the feeding portion is located below a powder surface of the toner with respect to a direction of gravitation, and the feeding sheet is located in a position where the feeding sheet is contactable to an inner wall of the toner chamber.

18 Claims, 7 Drawing Sheets

(56) References Cited

U.S. PATENT DOCUMENTS

| | | | | |
|---|---|---|---|---|
| 6,131,007 | A | 10/2000 | Yamaguchi et al. | |
| 6,275,668 | B1 | 8/2001 | Batori | |
| 6,334,035 | B1 | 12/2001 | Abe et al. | |
| 6,363,226 | B1 | 3/2002 | Batori | |
| 6,714,746 | B2 | 3/2004 | Morioka et al. | |
| 6,735,405 | B2 | 5/2004 | Yokoi et al. | |
| 6,836,639 | B2 | 12/2004 | Karakama et al. | |
| 6,898,392 | B2 | 5/2005 | Karakama et al. | |
| 6,937,832 | B2 | 8/2005 | Sato et al. | |
| 6,963,706 | B2 | 11/2005 | Morioka et al. | |
| 6,987,938 | B2 | 1/2006 | Murakami et al. | |
| 7,024,131 | B2 | 4/2006 | Komatsu et al. | |
| 7,079,787 | B2 | 7/2006 | Ogino et al. | |
| 7,127,192 | B2 | 10/2006 | Batori et al. | |
| 7,136,604 | B2 | 11/2006 | Chadani et al. | |
| 7,156,797 | B2 | 1/2007 | Komatsu et al. | |
| 7,200,349 | B2 | 4/2007 | Sato et al. | |
| 7,206,534 | B2 | 4/2007 | Murakami | |
| 7,349,657 | B2 * | 3/2008 | Sato et al. | 399/258 |
| 7,418,225 | B2 | 8/2008 | Morioka et al. | |
| 7,885,575 | B2 | 2/2011 | Batori et al. | |
| 8,081,898 | B2 | 12/2011 | Batori et al. | |
| 8,326,185 | B2 | 12/2012 | Asanuma et al. | |
| 8,406,656 | B2 | 3/2013 | Batori et al. | |
| 8,565,640 | B2 | 10/2013 | Batori et al. | |
| 8,620,181 | B2 | 12/2013 | Murakami | |
| 8,649,709 | B2 * | 2/2014 | Ichikawa | 399/258 |
| 8,676,085 | B1 | 3/2014 | Batori et al. | |
| 2012/0294649 | A1 | 11/2012 | Kikuchi et al. | |
| 2014/0086620 | A1 | 3/2014 | Takeuchi et al. | |
| 2014/0086632 | A1 | 3/2014 | Batori | |
| 2014/0093272 | A1 | 4/2014 | Matsumaru et al. | |
| 2014/0105639 | A1 | 4/2014 | Kikuchi et al. | |

FOREIGN PATENT DOCUMENTS

| | | |
|---|---|---|
| JP | 05-197288 | 6/1993 |
| JP | 2011-047981 A | 3/2011 |

* cited by examiner (a)

(b)

CARTRIDGE, PROCESS CARTRIDGE AND IMAGE FORMING APPARATUS

FIELD OF THE INVENTION AND RELATED ART

The present invention relates to a cartridge and a process cartridge which are to be used for image formation of an electrophotographic type, and relates to an image forming apparatus to which the cartridge and the process cartridge are detachably mountable.

An electrophotographic image forming apparatus has been conventionally used. Here, the electrophotographic image forming apparatus forms an image on a recording material (such as recording paper or an OHP sheet) by using the electrophotographic type. Examples of a main assembly of the electrophotographic image forming apparatus may include, e.g., an electrophotographic copying machine, an electrophotographic printer, a facsimile machine and a multi-function machine (multi-function printer), and the like.

Further, a developing cartridge to be used for the image formation of the electrophotographic type refers to a developing cartridge prepared by integrally assembling a developing device into a cartridge, which is to be detachably mountably mounted in the electrophotographic image forming apparatus main assembly.

Here, the process cartridge to be used for the image formation of the electrophotographic type refers to a process cartridge prepared by integrally assembling an electrophotographic photosensitive drum and, as a process means actable on the electrophotographic photosensitive drum, at least one of a charging means, a developing means and a cleaning means into a cartridge. Then, this process cartridge is detachably mounted into the electrophotographic image forming apparatus main assembly.

In the image forming apparatus using the electrophotographic image forming type, firsts, a latent image is formed by subjecting the electrophotographic photosensitive drum, which is uniformly electrically charged by the charging means, to selective exposure to light depending on image information. Then, the latent image is developed with a toner by a developing means, so that a toner image is formed. Thereafter, the toner image formed on the electrophotographic photosensitive drum is transferred onto the recording material to effect image formation.

Here, a constitution in which a toner supply opening for permitting communication between a toner chamber and a toner supplying chamber is sealed by using a toner seal member, and then the toner seal member is unsealed by a rotatable member has been proposed (Japanese Laid-Open Patent Application (JP-A) Hei 5-197288).

In JP-A Hei 5-197288, the unsealing of the toner seal member is performed by automatically winding up the toner seal member, around the rotatable member, mounted at an end thereof on the rotatable member in the toner chamber. After the unsealing of the toner seal member, the toner seal member is rotated integrally with the rotatable member. Then, by a feeding sheet mounted similarly on the rotatable member, the toner in the toner chamber is fed to the toner supplying chamber.

As a result, it is possible to prevent leakage of the toner caused by vibration or impact during transportation of the process cartridge. The toner seal member remains in the process cartridge, and therefore there is no need for a user to treat the toner seal member. Further, there is no need for the user to unseal the toner seal member, and therefore usability is improved.

However, in the constitution described in JP-A Hei 5-197228, when the toner was fed to the toner supplying chamber after the unsealing of the toner seal member, only an elastic force was used. For this reason, it took much time until the toner in a sufficient amount was supplied to the developing means in the toner supplying chamber and then the process cartridge was in an image formable state.

SUMMARY OF THE INVENTION

A principal object of the present invention to provide a cartridge, a process cartridge and an image forming apparatus which are capable of shortening a time until these cartridges or the image forming apparatus is in an image formable state.

According to an aspect of the present invention, there is provided a cartridge comprising: a toner chamber for accommodating a toner; and a toner supplying chamber, in which a developing roller is provided, for supplying the toner to the developing roller through a developer supply opening communicating with the toner chamber, wherein the toner chamber includes: a feeding portion, including a rotatable member rotatably supported and a feeding sheet connected with the rotatable member, for feeding the toner from the toner chamber to the toner supplying chamber; and a toner seal member, including a first end portion connected with the feeding portion and a second end portion for sealing the toner supply opening, for unsealing the toner supply opening by being wound up by the rotatable member with rotation of the rotatable member, and wherein during start of unsealing of the toner supply opening, the feeding portion is located below a powder surface of the toner with respect to a direction of gravitation, and the feeding sheet is located in a position where the feeding sheet is contactable to an inner wall of the toner chamber.

These and other objects, features and advantages of the present invention will become more apparent upon a consideration of the following description of the preferred embodiments of the present invention taken in conjunction with the accompanying drawings.

Figure 6:
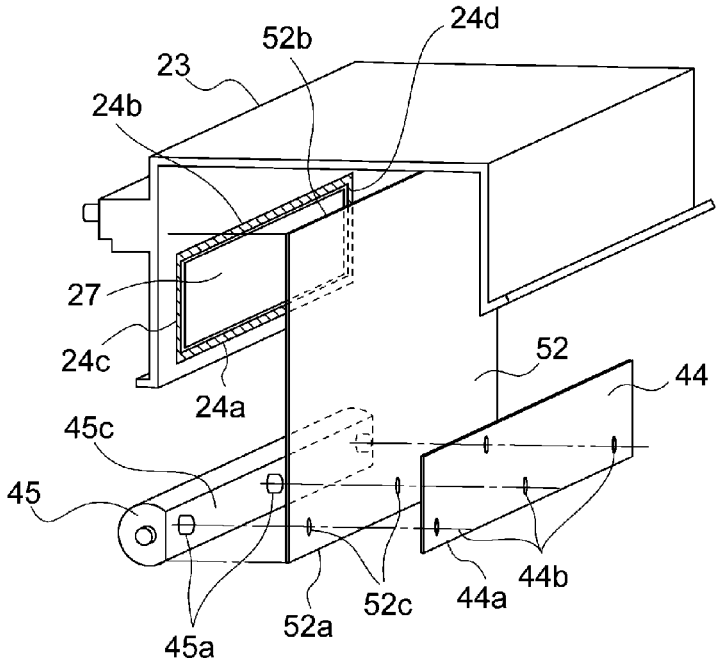
Figure 6:
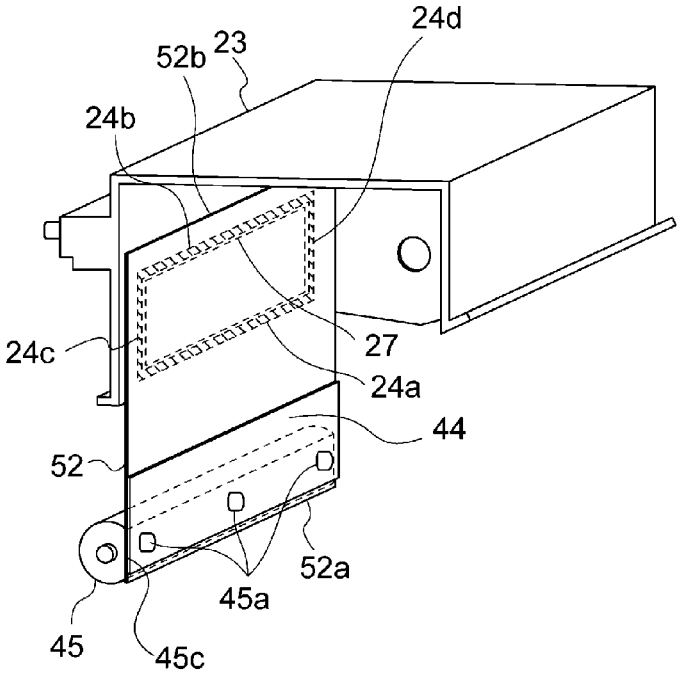

Parts (a) and (b) of FIG. 6 are an exploded perspective view and a perspective illustration, respectively, showing the structure of the developing unit.

Figure 7:
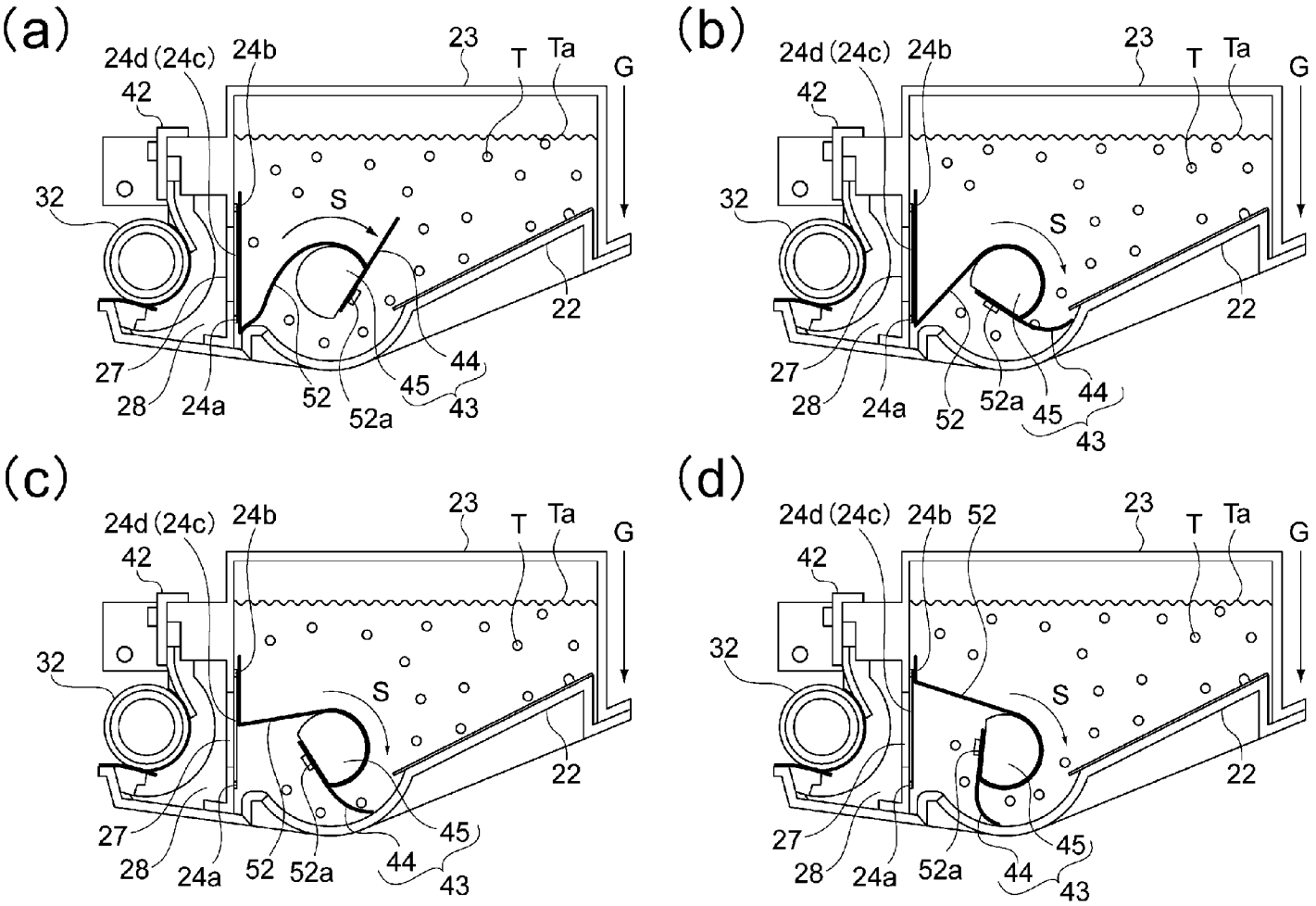

Parts (a) to (d) of FIG. 7 are sectional views for illustrating an unsealing operation of a toner seal member.

DESCRIPTION OF THE PREFERRED EMBODIMENTS

With reference to the drawings, embodiments of the present invention will be described specifically. Incidentally, a rotational axis direction of an electrophotographic photosensitive drum 62 is referred to as a longitudinal direction. Further, with respect to the longitudinal direction, a side where the photosensitive drum receives a driving force from a main assembly of an electrophotographic image forming apparatus is referred to as a driving side (a driving force receiving portion 63*a* side shown in FIG. 4), and its opposite side is referred to as a non-driving side.

A general structure of the image forming apparatus and an image forming process will be described with reference to FIGS. 1 and 2.

Figure 1:
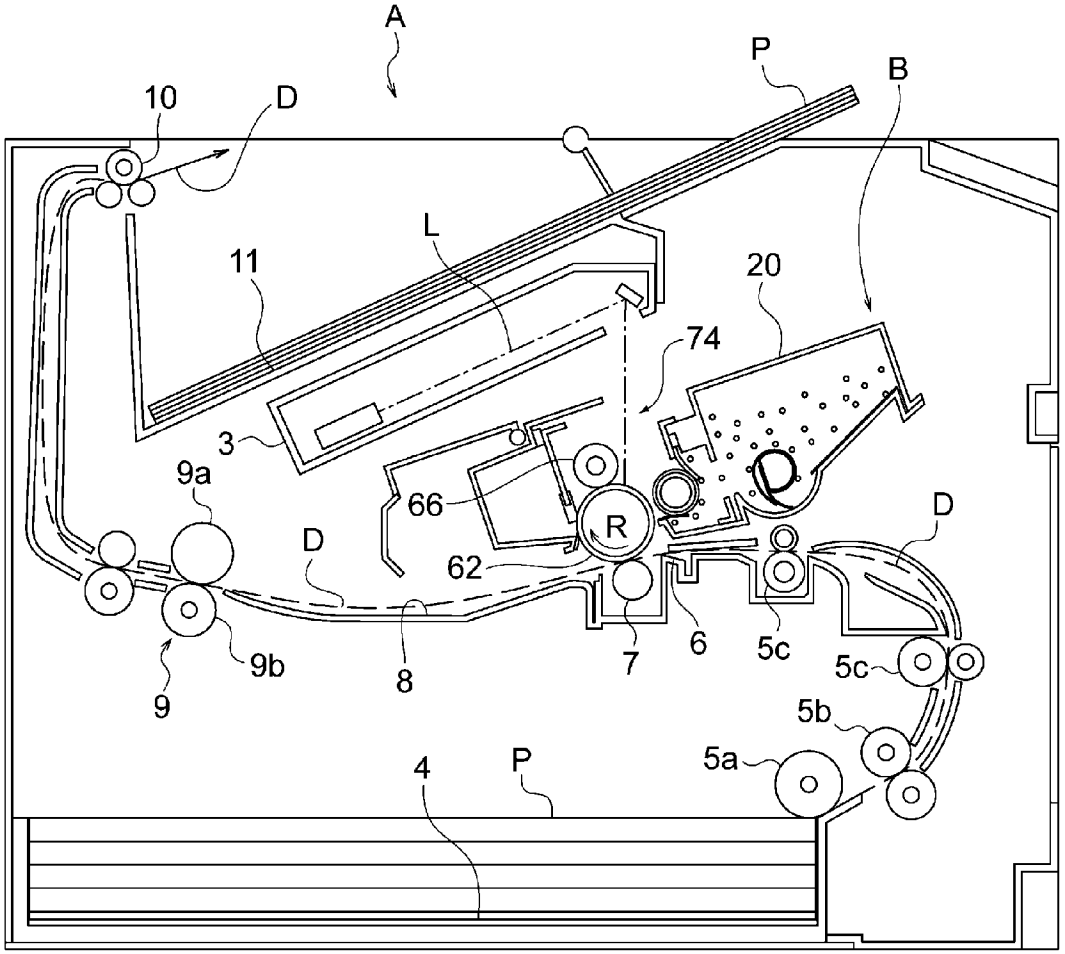
FIG. 1 is a sectional illustration showing a general structure of an image forming apparatus main assembly and a process cartridge.

FIG. 1 is a sectional view of a main assembly of the image forming apparatus and a process cartridge. FIG. 2 is a sectional view of the process cartridge. Here, the main assembly of the electrophotographic image forming apparatus (apparatus main assembly A) refers to a portion of the image forming apparatus from which the process cartridge B is removed.

[General Structure of Image Forming Apparatus]

In FIG. 1, the image forming apparatus in this embodiment is a laser beam printer, using an electrophotographic technique, in which the process cartridge B is detachably mountable to the apparatus main assembly A. When the process cartridge B is mounted in the apparatus main assembly A, above the process cartridge B, an exposure device 3 (laser scanner unit) is provided.

Further, below the process cartridge B, a sheet (feeding) tray 4 in which a recording material (sheet material P) to be subjected to image formation is accommodated is provided.

Further, in the apparatus main assembly A, along a conveyance direction D of the sheet material P, a pick-up roller 5*a*, a feeding roller pair 5*b*, conveying roller pairs 5*c*, a transfer guide 6, a transfer roller 7, a conveying guide 8, a fixing device 9, a discharging roller pair 10, a discharge tray 11 and the like are successively provided. Incidentally, the fixing device 9 is constituted by a heating roller 9*a* and a pressing roller 9*b*.

[Image Forming Process Operation]

Next, the image forming process will be described. On the basis of a print start signal, the photosensitive drum 62 (photosensitive member) is rotationally driven at a predetermined peripheral speed (process speed) in an arrow R direction in FIG. 1.

A charging roller 66 to which an unshown charging bias voltage is applied contacts the outer peripheral surface of the photosensitive drum 62 and electrically charges the outer peripheral surface of the photosensitive drum 62 uniformly.

The exposure device 3 outputs laser light 3*a* depending on image information. The laser light L passes through an exposure window portion 74 provided at an upper surface of the process cartridge B, so that the outer peripheral surface of the photosensitive drum 62 is subjected to scanning exposure. As a result, on the outer peripheral surface of the photosensitive drum 62, an electrostatic latent image depending on the image information is formed.

Figure 2:
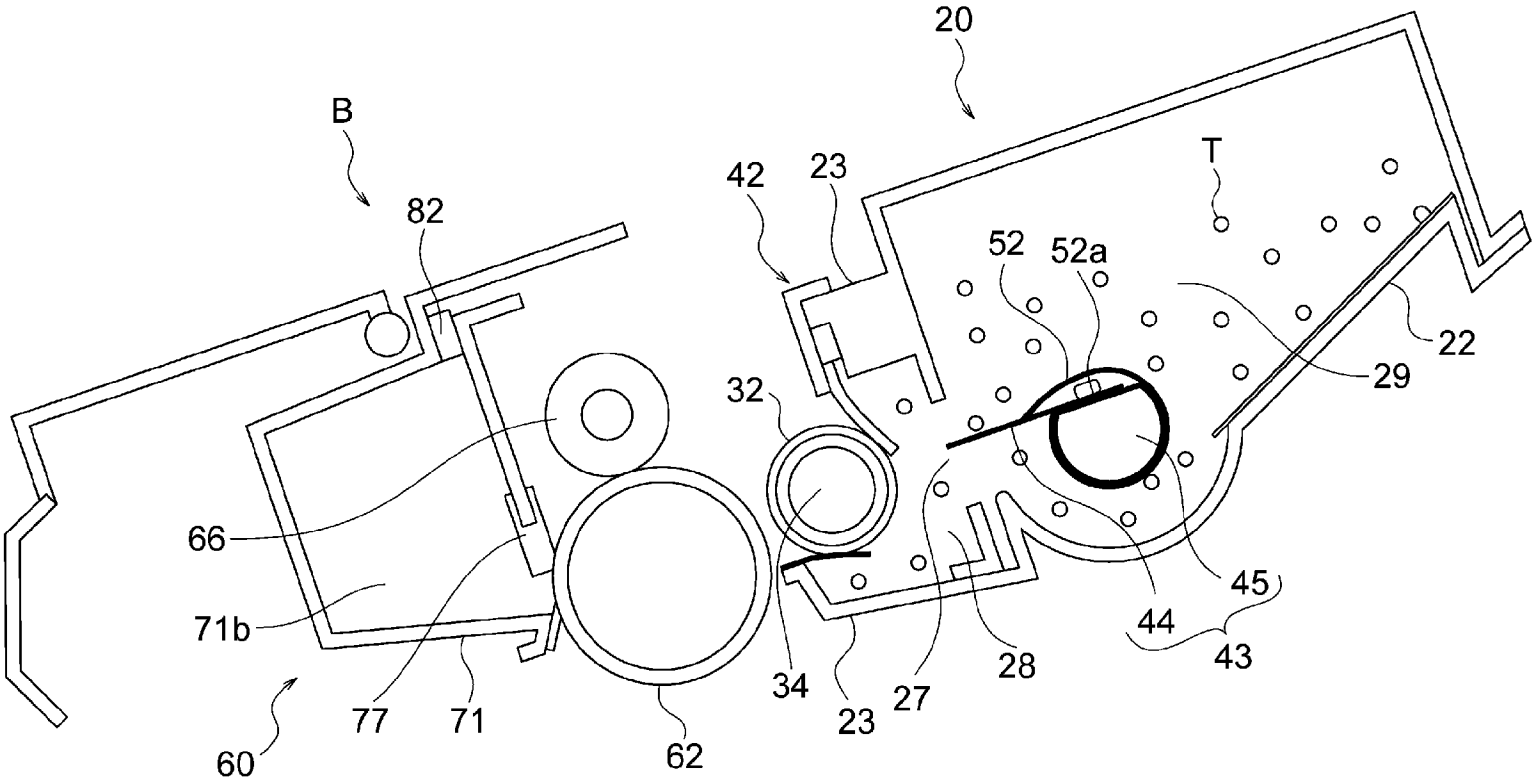
FIG. 2 is a sectional illustration showing a structure of the process cartridge.

On the other hand, as shown in FIG. 2, in a developing unit 20 (cartridge), a toner T in a toner chamber 29 is stirred and fed by rotation of a feeding portion 43, so that the toner T is sent to a toner supplying chamber 28.

The toner T is carried on a surface of a developing roller 32 by a magnetic force of a magnet roller 34 (fixed magnet). The toner T is regulated in layer thickness by a developing blade 42 while being triboelectrically charged. The toner T is transferred onto the photosensitive drum 62 depending on the electrostatic latent image, so that the electrostatic latent image is visualized as a toner image.

Further, as shown in FIG. 1, the sheet material P is accommodated at a lower portion of the apparatus main assembly A. In synchronism with output timing of the laser light L, by the pick-up roller 5*a*, the feeding roller pair 5*b* and the conveying roller pair 5*c*, the sheet material P is fed and conveyed from the sheet tray 4.

The sheet material P is conveyed to a transfer position between the photosensitive drum 62 and the transfer roller 7 via the transfer guide 6. In this transfer position, the toner image is successively transferred from the photosensitive drum 62 onto the sheet material P.

The sheet material P on which the toner image is transferred is separated from the photosensitive drum 62 and then is conveyed to the fixing device 9 along the conveying guide 8. Then, the sheet material P passes through a fixing nip between the heating roller 9*a* and the pressing roller 9*b* which constitute the fixing device 9. At this fixing nip, pressure and heat fixing is effected, so that the toner image is fixed on the sheet material P. The sheet material P on which the toner image is fixed is conveyed to the discharging roller pair 10 and then is discharged onto the discharge tray 11.

On the other hand, as shown in FIG. 2, the photosensitive drum 62 after the transfer is, after a residual toner on the outer peripheral surface of the photosensitive drum 62 is removed by a cleaning blade 77, used again in the image forming process. The residual toner removed from the photosensitive drum 62 is stored in a residual toner chamber 71*b* of a cleaning unit 60.

In the above-described constitution, the charging roller 66, the developing roller 32, and the cleaning blade 77 are the process means actable on the photosensitive drum 62.

[General Structure of Process Cartridge]

Figure 3:
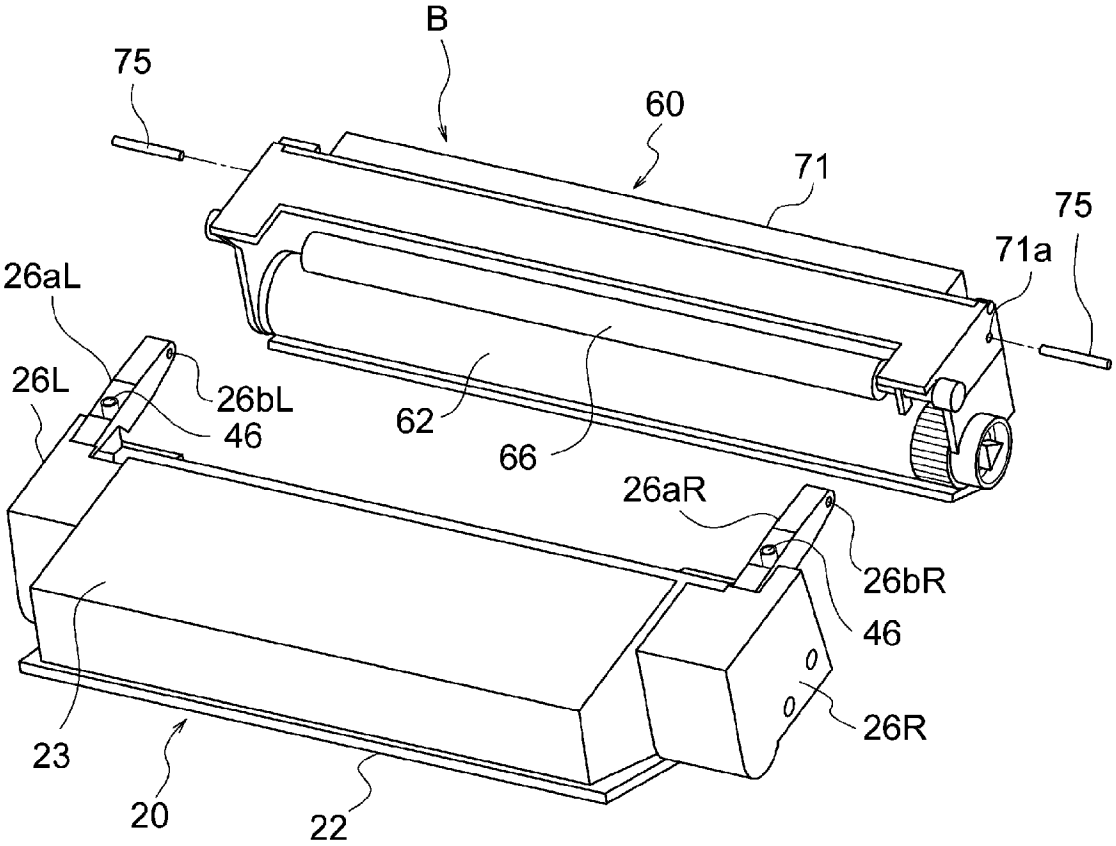
FIG. 3 is an exploded perspective view showing the structure of the process cartridge.

Next, with respect to FIGS. 2 and 3, a general structure of the process cartridge B will be described. FIG. 3 is a perspective view for illustrating a structure of the process cartridge B.

The process cartridge B is constituted by combining the cleaning unit 60 and the developing unit 20.

The cleaning unit 60 is constituted by a cleaning frame 71, the photosensitive drum 62, the charging roller 66, the cleaning blade 77 and the like.

On the other hand, the developing unit 20 is constituted by a developing container 23, a bottom member 22, first and second side members 26L and 26R, a developing blade 42, a developing roller 32, a magnet roller 34, the feeding portion 43, the toner T, an urging member 46, and the like.

The cleaning unit 60 and developing unit 20 are rotationally movably connected with each other by a connecting member 75, so that the process cartridge B is constituted.

Specifically, at an end portion of an arm portion 26*a*L formed on the first side member 26L provided at an end portion of the developing unit 20 with respect to a longitudinal direction of the developing unit 20 (a rotational axis direction of the developing roller 32), a rotational movement hole 26*b*L in parallel with the developing roller 32 is provided. Further, at an end portion of an arm portion 26*a*R formed on the second side member 26R provided at another end portion of the developing unit 20, a rotational movement hole 26*b*R in parallel with the developing roller 32 is provided.

Further, at each of longitudinal end portions of the cleaning frame 71, an engaging hole 71*a* for permitting engagement therein of the connecting member 75 is formed. Then, the arm portions 26*a*L and 26*a*R are aligned with predetermined positions of the cleaning frame 71, and then the connecting members 75 are inserted into the rotational movement holes 26*b*L and 26*b*R and the engaging holes 71*a*. As a result, the cleaning unit 60 and the developing unit 20 are connected with each other rotatably about the connecting members 75.

At this time, urging members 46 mounted at base portions of the arm portions 26*a*L and 26*a*R abut against the cleaning frame 71, so that the urging members 46 urge the developing unit 20 toward the cleaning unit 60 with the connecting members 75 as the rotation centers. As a result, the developing roller 32 is pressed toward the photosensitive drum 62 with reliability.

Then, by a gap (spacing) holding member 38 (FIG. 5) mounted at each of the end portions of the developing roller 32, the developing roller 32 is held with a predetermined gap from the photosensitive drum 62.

[Structure of Cleaning Unit]

Figure 4:
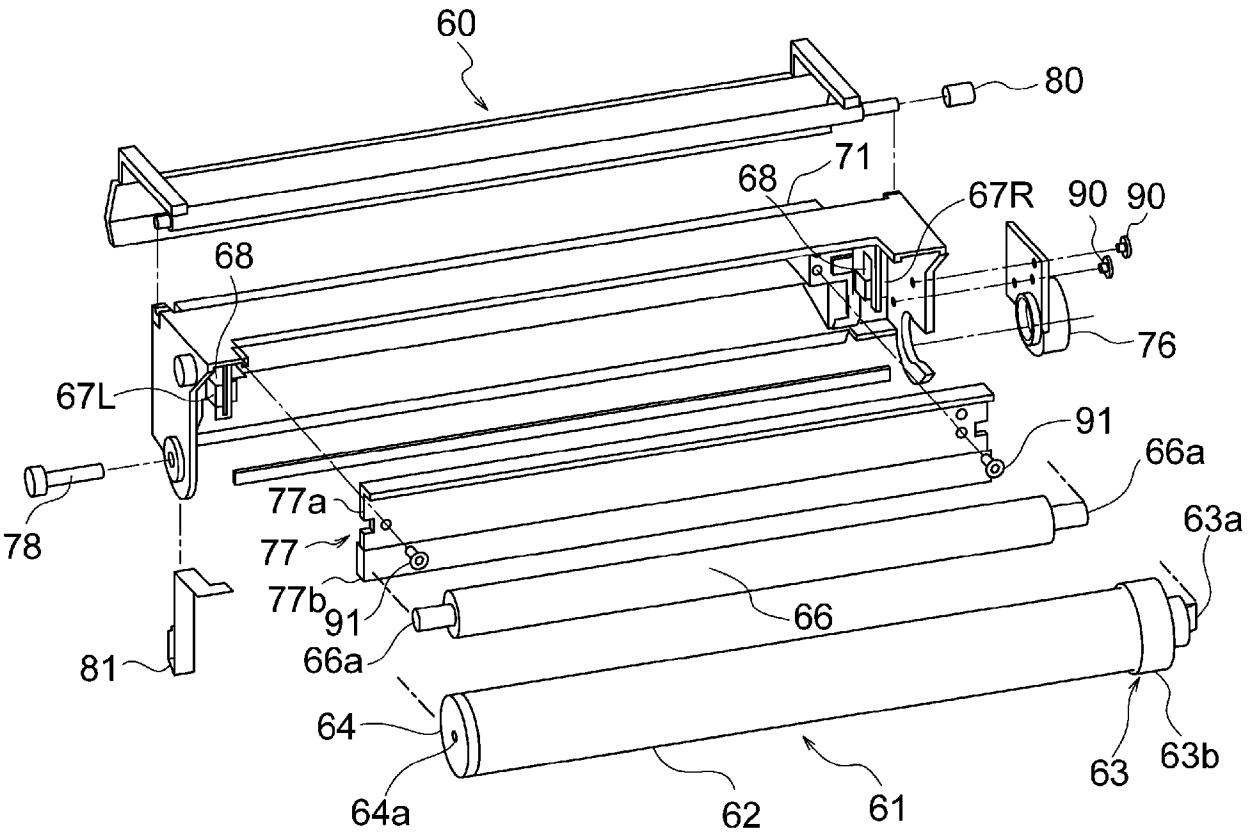
FIG. 4 is an exploded perspective view showing a structure of a cleaning unit.

Next, a structure of the cleaning unit 60 will be described with reference to FIG. 2. FIG. 4 is an exploded perspective view for illustrating the structure of the cleaning unit 60.

A cleaning blade 77 is constituted by a supporting member 77*a* formed with a metal plate and an elastic member 77*b* formed of an elastic material such as urethane rubber, and is fixed on the cleaning frame 71 by screws 91 at longitudinal end portions of the supporting member 77*a*, thus being provided in a predetermined position. The elastic member 77*b* contacts the photosensitive drum 62, so that the residual toner is removed from the outer peripheral surface of the photosensitive drum 62. The removed toner is stored in the residual toner chamber 71*b* (FIG. 2).

An electrode plate 81, an urging member 68 and charging roller bearings 67L and 67R are mounted on the cleaning frame 71.

A shaft portion 66*a* of the charging roller 66 is engaged into the charging roller bearings 67L and 67R. The charging roller 66 is urged toward the photosensitive drum 62 by the urging member 68, and is rotatably supported by the charging roller bearings 67L and 67R. Then, the charging roller 66 is rotated by rotation of the photosensitive drum 62.

The photosensitive drum 62 is connected integrally with flanges 63 and 64 and thus is constituted as an electrophotographic photosensitive drum unit 61. This connecting method uses caulking, bonding, welding or the like.

To the flange 64, an unshown grounding contact and the like are connected. Further, the flange 63 includes a driving force receiving portion 63*a* for receiving a driving force from the apparatus main assembly A and includes a flange gear portion 63*b* for transmitting the driving force to the developing roller 32.

The bearing member 76 is integrally fixed on the cleaning frame 71 in the driving side, and the drum shaft 78 is press-fitted and fixed in the cleaning frame 71 in the non-driving side.

Further, the bearing member 76 is engaged with the flange 63, and a drum shaft 78 is engaged with a hole 64*a* of the flange 64. As a result, the drum unit 61 is rotatably supported by the cleaning frame 71.

[Developing Unit]

Figure 5:
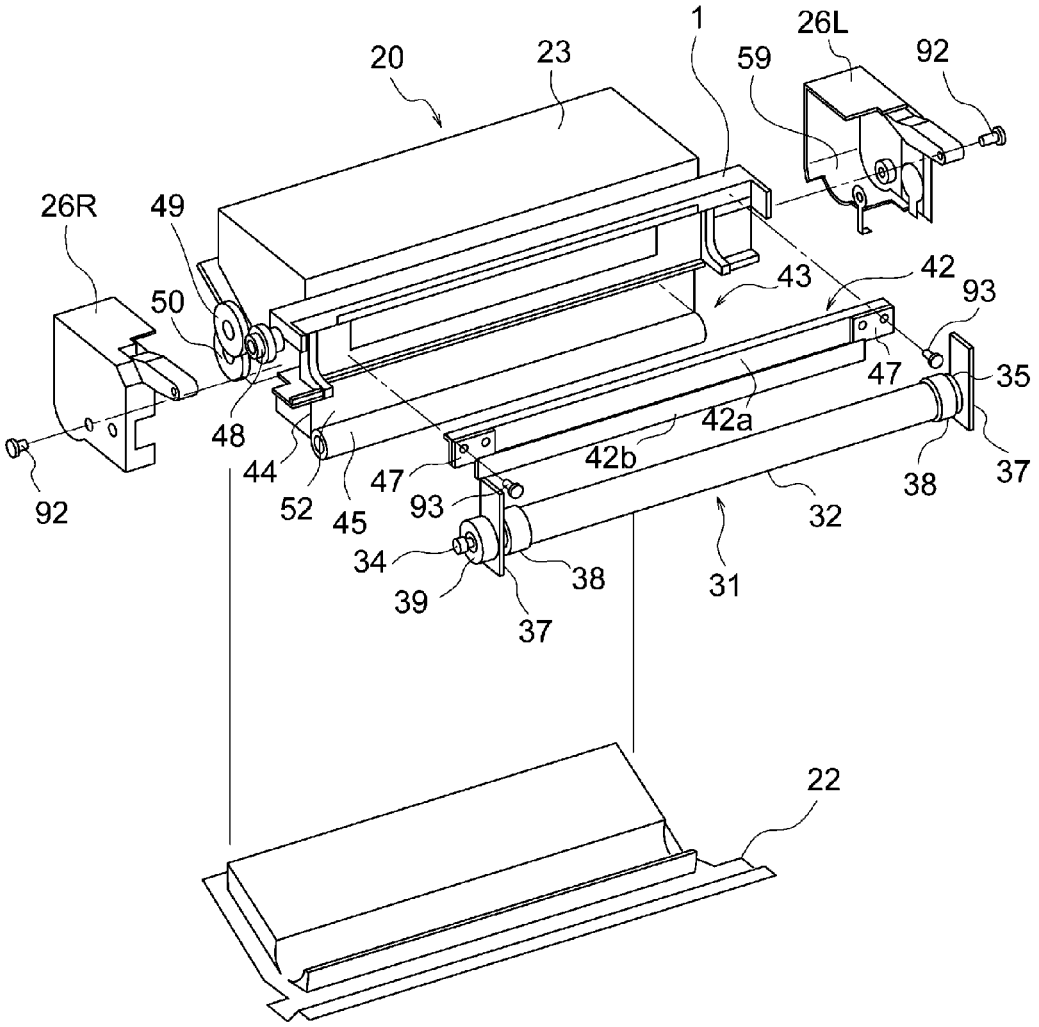
FIG. 5 is an exploded perspective view showing a structure of the developing unit.

Next, a structure of the developing unit 20 will be described with reference to FIG. 5. FIG. 5 is an exploded perspective view for illustrating the structure of the developing unit 20.

A developing (device) frame consisting of the developing container 23 and the bottom member 22 defines the toner chamber 29 in which the toner T is accommodated, and the toner supplying chamber 28 (FIG. 2). The developing container 23 and the bottom member 22 are integrally connected with each other by welding or the like.

The feeding portion 43 is constituted by a rotatable member 45 to be rotatably supported and a feeding sheet 44 connected with the rotatable member 45.

The feeding portion 43 is supported by the developing container 23 in the non-driving side, and is fixed to a feeding gear 50 mounted in the developing container 23 in the driving side. As a result, the feeding portion 43 is rotated in the toner chamber 29 by the rotation of the feeding gear 50.

The developing blade 42 is constituted by a supporting member 42*a* formed with a metal plate and an elastic member 42*b* formed of an elastic material such as an urethane rubber, and is fixed together with a cleaning member 47 in a predetermined position relative to the developing container 23 by 93 at end portions of the supporting member 42*a*.

A developing roller unit 31 is constituted by the developing roller 32, the magnet roller 34, a flange 35, the gap holding member 38, a bearing member 37, a developing roller gear 39 and the like.

From an end portion of the developing roller 32 in the non-driving side, the magnet roller 34 is inserted, and at the end portion, the flange 35 is press-fitted and fixed. The gap holding member 38 is mounted at each of the end portions of the developing roller 32. Further, outside the gap holding member 38, the bearing member 37 is disposed, and in the driving side, the developing roller gear 39 is assembled outside the bearing member 37. By the bearing member 37 disposed at each of the end portions of the developing roller 32, the developing roller 32 is rotatably supported.

First and second gears 48 and 49 as a drive transmission member are rotatably engaged with the developing frame 1. As a result, the driving force receiving from the apparatus main assembly A is transmitted to the developing roller 32 and the feeding portion 43 by successive engagement and rotation of the flange gear portion 63*b* (FIG. 4), the developing roller gear 39, the first and second gears 48 and 49, and the feeding gear 50.

The first and second side members 26L and 26R are fixed with screws 92 at end portions, respectively, of the developing frame with respect to the longitudinal direction of the developing frame.

At that time, the bearing members 37 of the developing roller unit 31 are held by the first and second side members 26L and 26R.

[Structure of Toner Seal Member and Unsealing Operation]

(Toner Seal Member Toner Feeding Portion)

Next, with reference to FIGS. 2, 6 and 7, a toner seal structure will be described. Parts (a) and (b) of FIG. 6 are perspective views for illustrating the toner seal structure. Parts (a) to (d) of FIG. 7 are sectional illustrations showing an unsealing operation of the toner seal member 52.

As shown in FIG. 2, the developing container 23 is provided with the toner supply opening 27 for establishing communication between the toner chamber 29 and the toner supplying chamber 28.

Next, with reference to FIG. 6, the toner seal member 52 will be described. The toner seal member 52 is constituted by a material compatible with a material for the developing container 23 or a material including an adhesive layer. The feeding sheet 44 is formed of a flexible material such as polyethylene terephthalate (PET), polycarbonate (PC) or polyphenylene sulfide (PPS).

As shown in (a) of FIG. 6, a first end portion 52*a* which is a lower end portion of the toner seal member 52 and which is to be connected with the feeding portion 43, and a first end portion 44*a* of the feeding sheet 44 are provided with a plurality of engaging holes 52*c* and a plurality of engaging holes 44*b*, respectively, so as to be disposed along the longitudinal direction of the rotatable member 45. Further, the rotatable member 45 is provided with a plurality of engaging projections 45*a*.

Then, the engaging holes 52*a* of the toner seal member 52 and the engaging holes 44*b* of the feeding sheet 44 are successively engaged in this order with the engaging projections

45*a* of the rotatable member 45. Thereafter, by thermally caulking the engaging projections 45*a* of the rotatable member 45, the toner seal member 52, the feeding sheet 44 and the rotatable member 45 are integrally provided.

Incidentally, a method of integrating the toner seal member 52, the feeding sheet 44 and the rotatable member 45 may also be another method using welding, snap-fitting, double-side tape or the like, and is not necessarily limited.

The toner seal member 52 is required to have a length in which the toner seal member 52 can cover the toner supply opening 27 and is mountable on the feeding portion 43. Here, in order to prevent the end portion 52*b* of the toner seal member 52 from contacting the end of the feeding sheet 44 after the toner seal member 52 is unsealed, the feeding sheet 44 and the toner seal member 52 have the same mounting phase.

As shown in (b) of FIG. 6 a second end portion 52*b*, which is an upper end portion of the toner seal member 52, for unsealing the toner supply opening 27 is welded on the developing container 23 along an edge of the toner supply opening 27 by the thermal welding or the like. This welded portion is the sealing portion 24.

Here, the sealing portion 24 is constituted by a first sealing portion 24*a* and a second sealing portion 24*b* which are provided along a longitudinal direction of the toner supply opening 27 and by a third sealing portion 24*c* and a fourth sealing portion 24*d* which are provided along a widthwise direction of the toner supply opening 27. Further, the first to fourth sealing portions 24*a*, 24*b*, 24*c* and 24*d* are continuously formed, so that it becomes possible to seal (confine) the toner.

The first sealing portion 24*a* is located in the first end portion 52*a* side of the toner seal member 52 as seen from the toner supply opening 27.

The second portion 24*b* is located in an opposite side (second end portion 52*a* side).

The third sealing portion 24*c* is located in the non-driving side, and the fourth sealing portion 24*d* is located in the driving side.

As shown in (a) of FIG. 7, the toner seal member 52 is loosen between the first sealing portion 24*a* thereof and the engaging holes 52*c* as an engaging portion. As a result, even when a force acts on the rotatable member 45 during assembling and transportation of the process cartridge B, the toner seal member 52 is partly loosened and therefore tension is not applied to the toner seal member 52. Thus, a sealing force can be maintained.

(Unsealing Operation of Toner Seal Member)

Next, an unsealing operation of the toner seal member 52 performed at the time of start of use of the process cartridge B will be described with reference to FIG. 7.

As shown in (a) of FIG. 7, when the process cartridge B is mounted in the apparatus main assembly and receives the driving force from the apparatus main assembly A, the rotatable member 45 is rotated in an arrow S direction. When the rotatable member 45 is rotated, the toner seal member 52 is wound up around the outer peripheral surface of the rotatable member 45, and tension is applied to the toner seal member 52.

During the start of such an unsealing operation of the toner supply opening 27, the feeding portion 43 is located below a powder surface Ta of the toner T with respect to the direction of gravitation (arrow G direction), and the feeding sheet 44 is located in a contactable position with the bottom member 22 which is an inner wall of the toner chamber 29. For this reason, as shown in (b) of FIG. 7, the toner located in a region X defined by the toner seal member 52, the rotatable member 45, the feeding sheet 44 and the bottom member 52 is in a pressure-received state.

Incidentally, the power surface Ta refers to an upper surface of the toner T accommodated in the developing container 23. Further, the direction of gravitation refers to a vertical direction.

When the rotatable member 45 is further rotated, the first sealing portion 24*a* of the toner seal member 52 is peeled off. For that reason, a part of the toner supply opening 27 is unsealed. Then, the pressure applied to the toner T located in the region X is released (removed), and concurrently, by the elastic force of the feeding sheet 44, the toner T is fed to the toner supplying chamber 28 ((c) of FIG. 7).

When the rotatable member 45 is further rotated ((d) of FIG. 7), the toner seal member 52 is peeled off in the order of the third and four sealing portions 24*c* and 24*d*, and the second sealing portion 24*b*. As a result, the toner supply opening 27 is completely unsealed (FIG. 2).

In this case, by the elastic force of the feeding sheet 44, the toner in a further large amount is fed to the toner supplying chamber 28, and therefore the toner in the large amount can be supplied to the developing roller 32 in a short time from start of the rotation of the rotatable member 45. For that reason, it is possible to shorten a time from after the insertion of the process cartridge B to a printable state, so that usability can be improved.

As described above, according to the present invention, during the unsealing of the toner seal member 52, a toner feeding operation is performed by increasing the pressure by the elastic force of the feeding sheet 44. For this reason, the toner in the large amount can be supplied to the toner supplying chamber 28 earlier. Thus, the time from the insertion of the process cartridge B before use into the image forming apparatus main assembly A until the image forming apparatus is in the printable state can be shortened, and therefore usability is improved.

Incidentally, as shown in FIG. 2, the feeding sheet 44 may be made capable of projecting toward the toner supplying chamber 28 side through the toner supply opening 27. By employing such a constitution, when the end of the feeding sheet 44 passes through the toner supply opening 27, the end of the feeding sheet 44 is to be located in the toner supplying chamber 28 side, and therefore the toner located at the end of the feeding sheet 44 is located in the toner supplying chamber 28 side during the passing thereof through the toner supply opening 27. For that reason, the feeding sheet 44 can feed the toner T further reliably into the toner supplying chamber 28.

Incidentally, the feeding sheet 44 may only be required to be located in a contactable position with the bottom member 22 as an inner wall of the toner chamber 29 during the unsealing of the toner seal member 52, and therefore before the start of rotation of the rotatable member 45, the feeding sheet 44 may also be located in a non-contact position with the bottom member 22. That is, before the use of the developing unit 20, the feeding sheet 44 is positioned upstream of the contactable position with the bottom member 22 of the toner chamber 29 with respect to the rotational direction of the rotatable member 45. Further, a constitution in which a gap is provided between the feeding sheet 44 and the bottom member 22 of the toner chamber 29 is employed.

When the gap is formed in this way between the feeding sheet 44 and the bottom member 22, even in the case where the toner is located during the transportation, the localized toner enters the region X shown in (b) of FIG. 7 during the mounting of the process cartridge into the image forming apparatus main assembly. Thus, the toner in the large amount can be supplied to the toner supplying chamber 28 with a high degree of reliability.

With respect to functions, materials, shapes and relative arrangement of the constituent elements described in this embodiment, the scope of the present invention is not limited thereto unless otherwise specified.

Further, in this embodiment, the process cartridge B is detachably mountable to the apparatus main assembly A, but the developing unit 20 (cartridge) including the developing roller 32 may also be independently made detachably mountable to the apparatus main assembly A.

By the above-described constitution, it is possible to shorten a time from after the unsealing of the toner seal member until the image forming apparatus is in an image formable state.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 214341/2012 filed Sep. 27, 2012, which is hereby incorporated by reference.

What is claimed is:

1. A cartridge detachably mounting to an image forming apparatus, the cartridge comprising:

a toner chamber for accommodating a toner; and a toner supplying chamber, in which a developing roller is provided, said toner supply chamber having a toner supply opening communicating with said toner chamber;

a feeding portion, including a rotatable member and a feeding sheet connected with the rotatable member, for feeding the toner from said toner chamber to said toner supply chamber; and a toner seal member including a first end portion connected with said feeding portion and a second end portion for sealing said toner supply opening, wherein said feeding portion is located below a powder surface of the toner with respect to a direction of gravitation if the cartridge is mounted to the image forming apparatus, and said feeding sheet is contactable to an inner wall of said toner chamber.

2. A cartridge according to claim 1, wherein said feeding sheet has a length such that said feeding sheet is projectable toward a developing roller through the toner supply opening when said feeding sheet passes through the toner supply opening.

3. A cartridge according to claim 1, wherein before use of the cartridge, said feeding sheet is located upstream of a position where said feeding sheet is contactable to said inner wall of said toner chamber, and said feeding sheet has a spacing between itself and said inner wall of said toner chamber.

4. A process cartridge comprising:

a photosensitive member; and process means actable on said photosensitive member, wherein said process means is a developing roller of a cartridge according to claim 1.

5. An image forming apparatus comprising:

a cartridge, detachably mountable to said image forming apparatus, for developing an electrostatic latent image formed on a photosensitive member, wherein said cartridge is a cartridge according to claim 1.

6. An image forming apparatus comprising:

a process cartridge, detachably mountable to said image forming apparatus, including a photosensitive member and process means actable on said photosensitive member, wherein said process cartridge is a process cartridge according to claim 4.

7. A cartridge according to claim 1, wherein said rotatable member winds up said toner seal member to open the toner supply opening.

8. A cartridge according to claim 1, wherein said inner wall of said toner chamber is an inner bottom wall of said toner chamber.

9. A cartridge according to claim 1, wherein said feeding sheet contacts said inner wall of said toner chamber during an unsealing operation.

10. A cartridge according to claim 1, wherein before use of the cartridge, said feeding sheet is located upstream of a position where said feeding sheet is contactable to said inner wall of said toner chamber, and has a spacing between itself and said inner wall of said toner chamber.

11. A cartridge comprising:

a toner chamber accommodating a toner; and a toner supplying chamber, in which a developing roller is provided, said toner supplying chamber having an opening communicating with said toner chamber;

a feeding portion, including a rotatable member and a feeding sheet connected with said rotatable member, for feeding the toner from said toner chamber to said toner supplying chamber; and a toner seal member including a first end portion connected with said feeding portion and a second end portion for sealing the opening, wherein said second end portion has a first sealing portion upstream of the opening and a second sealing portion downstream of the opening with respect to rotational direction of said rotatable member, and wherein, when said first sealing portion is peeled off, said feeding sheet contacts an inner wall of said toner chamber.

12. A cartridge according to claim 11, wherein said rotatable member winds up said toner seal member to open the toner supply opening.

13. A cartridge according to claim 11, wherein said inner wall of said toner chamber is an inner bottom wall of said toner chamber.

14. A cartridge according to claim 11, wherein said feeding sheet contacts with said inner wall of said toner chamber during an unsealing operation.

15. A cartridge according to claim 11, wherein said feeding sheet has a length such that said feeding sheet is projectable toward said developing roller through the toner supply opening when said feeding sheet passes through the toner supply opening.

16. A process cartridge comprising:

a photosensitive member; and process means actable on said photosensitive member, wherein said process means is a developing roller of a cartridge according to claim 11.

17. An image forming apparatus comprising:

a cartridge, detachably mountable to the image forming apparatus, for developing an electrostatic latent image formed on a photosensitive member, wherein said cartridge is a cartridge according to claim 11.

18. An image forming apparatus comprising:

a process cartridge, detachably mountable to the image forming apparatus, including a photosensitive member and process means actable on said photosensitive member, wherein said process cartridge is a process cartridge according to claim 16.

* * * * *